US005179843A

United States Patent [19]

Cohausz

[11] Patent Number: 5,179,843

[45] Date of Patent: Jan. 19, 1993

[54] REMOTE CONTROLLED ROBOTIC REFRIGERATOR

[76] Inventor: Helge S. Cohausz, Schumannstrasse 97, D 4000 Düsseldorf 1, Fed. Rep. of Germany

[21] Appl. No.: 758,698

[22] Filed: Sep. 12, 1991

[51] Int. Cl.[5] ..... F25D 15/00

[52] U.S. Cl. ..... 62/237; 62/239; 901/1

[58] Field of Search ..... 62/237, 239, 243; 901/1

[56] References Cited

U.S. PATENT DOCUMENTS

| | | | |
|---|---|---|---|
| 5,109,66 | 5/1992 | Kobayashi et al. | 901/1 X |
| 2,187,270 | 1/1940 | Kirk | 62/239 |
| 2,506,448 | 5/1950 | Gregor | 62/237 |
| 3,178,902 | 4/1965 | Costantini et al. | 62/237 |
| 3,872,686 | 3/1975 | Patrie | 62/237 |
| 4,935,907 | 6/1990 | Friedman | 367/118 |
| 5,109,566 | 5/1992 | Kobayashi et al. | 901/1 X |

*Primary Examiner*—Albert J. Makay
*Assistant Examiner*—William C. Doerrler
*Attorney, Agent, or Firm*—Herbert Dubno; Yuri Kateshov

[57] ABSTRACT

The invention relates to a refrigerator for receiving foodstuffs and/or beverages, the refrigerator containing a travelling carriage, more particularly taking the form of a robot, which contains a refrigerated reception space for foodstuffs and/or beverages and can be driven out of the refrigerator and controlled automatically and/or remotely via an electronic system.

7 Claims, 1 Drawing Sheet

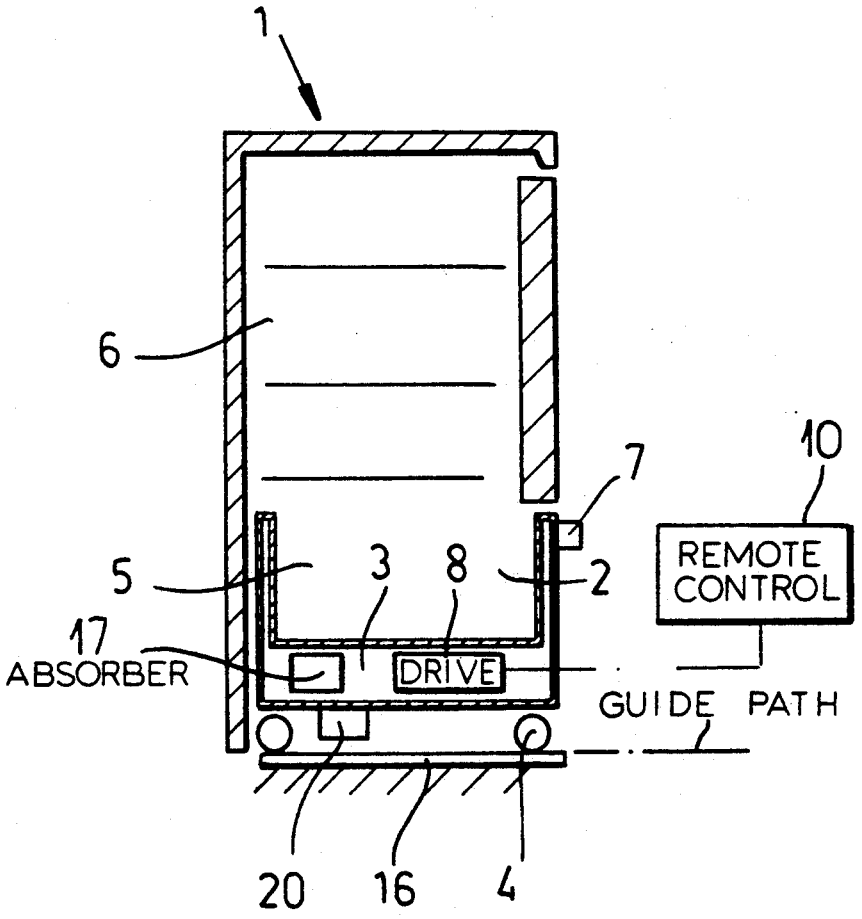
1
6
7
10
REMOTE CONTROL
5
3
8
2
17
ABSORBER
DRIVE
GUIDE PATH
20
16
4

REMOTE CONTROLLED ROBOTIC REFRIGERATOR

FIELD OF THE INVENTION

The invention relates to an automatically controlled refrigerator for delivering cooled foodstuffs and/or beverages in response to a remote control signal.

BACKGROUND OF THE INVENTION

One of the most frequent domestic activities is to go to the refrigerator in order to obtain a beverage. This activity takes up time, both to serve oneself and also to entertain guests.

OBJECTS OF THE INVENTION

It is therefore a principal object of the invention to provide a refrigerator which can move and deliver products over a distance.

SUMMARY OF THE INVENTION

This problem is solved according to the invention by the feature that the refrigerator contains a robotic drivable carriage which contains a refrigerated reception space for foodstuffs and/or beverages and which can be driven out of the housing of a refrigerator and be controlled automatically and/or remotely via an electronic system.

With the delivery of a signal, for example an acoustic signal, or remote control, for example, similar to a TV remote control the carriage/robot can be set in motion and caused to move out to a person who requires a refrigerated article contained in the refrigerated stowage space of the carriage/robot. The carriage can move over a previously designed guide system or find its own way by sensors communicating with the remote control generating pulses emitted by a remote control. It is therefore enough, for example, for a person in the living room to press a button on the remote control, whereafter the carriage/robot is set in motion and travels to that person. As soon as the article has been removed, the carriage/robot spontaneously moves back into the refrigerator. The carriage/robot has either itself taken note of the outward path, to return by the same route, or it uses a guide path or pulses regularly emitted by the remote control.

BRIEF DESCRIPTION OF THE DRAWING

The above and other objects, features and advantages will become more readily apparent from the following description. References are being made to the following drawing in which a single figure shows a diagrammatic vertical section of an embodiment of the invention.

SPECIFIC DESCRIPTION

The lower portion of a refrigerator 1 has an opening 1*a* whose base corresponds to the floor level or is the floor. A carriage/robot 3 having wheels 4 is driven into the opening 2 and completely fills this lower cavity of the refrigerator.

The carriage/robot has a storage/stowage space 5 which is more open upwardly and contains articles to be refrigerated, for example foodstuffs or beverages.

The carriage 3 has a drive and an electronic system remote control 10 which controls the drive and one wheel of a 3-wheeled carriage and two wheels of a 4-wheeled carriage, so that by the electronic system and the drive the carriage can be driven out of the space 5 and therefore out of the refrigerator 1. The carriage 3 can either move over a guide system 16 or be controlled by a remote control system 10, so it is able to find its own way, as soon as it has receives a required signal from the remote control. When the carriage/robot 3 has reached its destination, the article can be removed, whereafter the carriage spontaneously moves back into the refrigerator.

The carriage can be provided with means 20 responding to the guide path. As an alternative to means 20, the carriage can be equipped with sensors 7 preventing the carriage from running against obstacles.

The space 5 can be connected to the remaining interior 6 of the refrigerator, so that the space 5 is cooled by such connection as soon as the carriage/robot 3 is in the refrigerator. When the carriage/robot moves out, the space 6 can be automatically closed in the downward direction.

Alternatively, however, the space 5 can be always separated from the space 6 and contain its own refrigerating unit or at least a heat-absorbing element 17. Refrigeration can be performed by a single refrigerating unit of the refrigerator.

The carriage/robot 3 can also have other functions, more particularly operate as an automatic vacuum cleaner.

I claim:

1. A remote controlled robotic refrigerator system comprising:

remote control means for transmitting a signal;

a refrigerator spaced from said control means and comprising:

a housing having a bottom formed with an opening, a movable carriage received in said opening and formed with a refrigerated reception compartment, a drive on said carriage, and means on said carriage for receiving said signal and for actuating said drive, said carriage being controllably driven out of said opening along a path outside said housing toward said remote control means and being retracted back into said opening in response to said signal.

2. The refrigerator system defined in claim 1 wherein said refrigerator is provided with a cooling system mounted on said housing, said means on said carriage for receiving said signal including:

means for storing said path toward said remote control means, so that said carriage is automatically driven back into said opening along said path.

3. The refrigerator system defined in claim 1 wherein said carriage is provided with a heat absorber.

4. The refrigerator system defined in claim 1 wherein said remote control means transmits an acoustic signal.

5. The refrigerator system defined in claim 1 wherein said remote control means transmits a nonacoustic signal.

6. The refrigerator defined in claim 1 wherein said sensor means includes at least one sensor preventing said carriage from running into objects along said path.

7. The refrigerator system defined in claim 1, further comprising a guide path, said carriage being formed with means guiding said carriage along said path.

* * * * *